US009328965B2

(12) United States Patent
Terano

(10) Patent No.: US 9,328,965 B2
(45) Date of Patent: May 3, 2016

(54) HEAT EXCHANGER OF AIR CONDITIONING DEVICE INCLUDING A REFRIGERANT PATH ARRANGED DOWNSTREAM OF OTHER REFRIGERANT PATHS RELATIVE TO AIRFLOW DIRECTION

(71) Applicant: DAIKIN INDUSTRIES, LTD., Osaka-shi, Osaka (JP)

(72) Inventor: Kenji Terano, Sakai (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 0 days.

(21) Appl. No.: 14/387,923

(22) PCT Filed: Feb. 26, 2013

(86) PCT No.: PCT/JP2013/054890

§ 371 (c)(1),
(2) Date: Sep. 25, 2014

(87) PCT Pub. No.: WO2013/146006

PCT Pub. Date: Oct. 3, 2013

(65) Prior Publication Data

US 2015/0323218 A1 Nov. 12, 2015

(30) Foreign Application Priority Data

Mar. 26, 2012 (JP) ..... 2012-070034

(51) Int. Cl.
*F24F 7/00* (2006.01)
*F28F 13/00* (2006.01)
(Continued)

(52) U.S. Cl.
CPC ..... *F28D 1/0477* (2013.01); *F24F 1/0007* (2013.01); *F24F 1/0059* (2013.01);
(Continued)

(58) Field of Classification Search
CPC ..... F24F 13/30; F24F 1/00; F24F 1/0007; F25B 39/00; F28D 1/0477; F28F 1/32
USPC ..... 165/59, 173, 153, 139, 144, 150
See application file for complete search history.

(56) References Cited

U.S. PATENT DOCUMENTS 4,995,453 A * 2/1991 Bartlett ..... F25B 39/00 165/150
2004/0089020 A1 5/2004 Hong et al.
(Continued)

FOREIGN PATENT DOCUMENTS

EP 1821049 A1 8/2007
EP 1992888 A1 11/2008
(Continued)

OTHER PUBLICATIONS

Translation of Japanese Patent Document JP 2005133976 A entitled Translation—JP 2005133976 A, translated Sep. 2015.*
(Continued)

*Primary Examiner* — M. Alexandra Elve
*Assistant Examiner* — Paul Alvare
(74) *Attorney, Agent, or Firm* — Birch, Stewart, Kolasch & Birch, LLP

(57) ABSTRACT

There is provided a heat exchanger of an air conditioning device capable of improving heat exchange efficiency in heat transfer tubes arranged in downstream rows in an airflow direction to enhance cooling capacity. In the heat exchanger of the air conditioning device, a plurality of heat transfer tubes arrayed in three or more rows in the airflow direction are provided, and a refrigerant is distributed to a plurality of paths to be supplied to the heat transfer tubes, and the heat exchanger is used as a evaporator during cooling operation. The plurality of paths include a most downstream path made up of only the heat transfer tubes in a most downstream row in the airflow direction, and an upstream path made up of only the heat transfer tubes in a plurality of rows arranged on an upstream side of the most downstream path.

4 Claims, 11 Drawing Sheets

(51) Int. Cl.

| | |
|---|---|
| ***F28F 9/26*** | (2006.01) |
| ***F28F 1/10*** | (2006.01) |
| ***F28F 9/02*** | (2006.01) |
| ***F28D 1/047*** | (2006.01) |
| ***F24F 13/08*** | (2006.01) |
| ***F24F 13/30*** | (2006.01) |
| ***F25B 39/00*** | (2006.01) |
| ***F24F 1/00*** | (2011.01) |
| ***F28F 1/32*** | (2006.01) |
| *F25B 13/00* | (2006.01) |
| *F28D 21/00* | (2006.01) |

(52) U.S. Cl.
CPC ..... *F24F 13/08* (2013.01); *F24F 13/30* (2013.01); *F25B 39/00* (2013.01); *F28F 1/32* (2013.01); *F24F 2001/0037* (2013.01); *F25B 13/00* (2013.01); *F28D 2021/0071* (2013.01)

(56) References Cited

U.S. PATENT DOCUMENTS

2004/0118151 A1* 6/2004 Hebert ..... F25B 39/02 62/524
2006/0168982 A1* 8/2006 Moon ..... F24F 1/0007 62/324.1
2006/0168998 A1* 8/2006 Chin ..... F24F 1/0059 62/515
2007/0256816 A1* 11/2007 Higashida ..... F24F 1/0007 165/120
2009/0013715 A1* 1/2009 Setoguchi ..... F24F 1/0007 62/524
2009/0025413 A1* 1/2009 Koga ..... F24F 1/00 62/259.1

FOREIGN PATENT DOCUMENTS

| | | | | |
|---|---|---|---|---|
| EP | 2420754 | A1 | | 2/2012 |
| JP | 11-223483 | A | | 8/1999 |
| JP | 2001-174047 | A | | 6/2001 |
| JP | 2005133976 | A | * | 5/2005 |
| JP | 2007-040611 | A | | 2/2007 |
| JP | 2008-121996 | A | | 5/2008 |
| JP | 2009-030829 | A | | 2/2009 |
| JP | 2010-96480 | A | | 4/2010 |
| JP | 2011-163740 | A | | 8/2011 |

OTHER PUBLICATIONS

International Search Report issued in PCT/JP2013/054890, mailed on May 21, 2013.

* cited by examiner

HEAT EXCHANGER OF AIR CONDITIONING DEVICE INCLUDING A REFRIGERANT PATH ARRANGED DOWNSTREAM OF OTHER REFRIGERANT PATHS RELATIVE TO AIRFLOW DIRECTION

TECHNICAL FIELD

The present invention relates to a heat exchanger of an air conditioning device, and the air conditioning device.

BACKGROUND ART

In a heat exchanger provided in an indoor unit of an air conditioning device, heat transfer tubes in which a refrigerant is caused to flow are provided, and heat exchange is performed between the refrigerant in these heat transfer tubes and indoor air to thereby adjust a temperature of the indoor air to a desired value.

In a heat exchanger described in Patent Literature 1 listed below, a plurality of heat transfer tubes are arrayed in a plurality of stages in a height direction thereof and in three rows in a flow direction of air (an airflow direction). Moreover, generally, in the heat exchanger of the air conditioning device, the refrigerant is distributed to a plurality of paths to be supplied, and in each of the paths, the heat transfer tubes in the plurality of stages and in the plurality of rows are connected to one another to form one refrigerant flow channel.

CITATION LIST

Patent Literature

Patent Literature 1: Japanese Unexamined Patent Publication No. 2009-30829

SUMMARY OF INVENTION

Technical Problem

As in the above-described heat exchanger, in the case where the heat transfer tubes in each of the paths are arranged in the plurality of rows in the airflow direction, and the refrigerant sequentially flows from upstream rows to downstream rows in the airflow direction during cooling operation, the heat exchange between the refrigerant and the indoor air is mostly performed in the upstream rows of the heat transfer tubes, and a temperature of the refrigerant has already risen in the downstream rows, so that the heat exchange may be hardly performed in the downstream rows. For example, as shown in FIG. 11, while the temperature of the air passing through the heat exchanger is lowered by performing the heat exchange with the refrigerant in the heat transfer tubes in the first row and the second row, the heat exchange is hardly performed in the heat transfer tubes in the third row, and lowering of the temperature also becomes smaller. Thus, the heat transfer tubes in the more downstream rows are not used effectively, so that there is a possibility that cooling capacity cannot be sufficiently exerted. Moreover, when the air does not pass through the whole heat exchanger at an even velocity, there is a high possibility that the heat exchange in the heat transfer tubes in the downstream rows is not properly performed, particularly in an area where an airflow velocity is slow.

The present invention is achieved in light of the above-described situation, and an object of the present invention is to provide a heat exchanger of an air conditioning device capable of improving heat exchange efficiency in downstream heat transfer tubes in an airflow direction to enhance cooling capacity, and the air conditioning device.

Solution to Problem

The present invention provides a heat exchanger of an air conditioning device, in which a plurality of heat transfer tubes arrayed in three or more rows in an airflow direction are provided, and a refrigerant is distributed to a plurality of paths to be supplied to the heat transfer tubes, the heat exchanger being used as a evaporator during cooling operation, wherein the plurality of paths include the most downstream path made up of only the heat transfer tubes in a most downstream row in the airflow direction, and the upstream path made up of only the heat transfer tubes in a plurality of rows arranged on an upstream side of the most downstream path.

According to this configuration, the air passing through the heat exchanger performs heat exchange with the refrigerant in the upstream path, and then properly performs heat exchange with the refrigerant also in the most downstream path. Accordingly, heat exchange efficiency in the most downstream row can be improved, and cooling capacity can be enhanced.

According to the above-described configuration, it is preferable that the most downstream path is provided in a range across a downstream side of a plurality of the upstream paths.

The above-described configuration can sufficiently assure a length of the heat transfer tubes in the most downstream path, and superheat of the refrigerant flowing in the most downstream path can be properly attained during the cooling operation.

It is preferable that an air conditioning device according to the present invention includes the above-described heat exchanger, and a fan that generates an airflow passing through the heat exchanger, and that the most downstream path of the heat exchanger is provided, corresponding to an area where an airflow velocity is low in the air conditioning device.

As the velocity of the airflow passing through the heat exchanger is lower, the heat exchange is mostly performed in the rows on the upstream side of the heat exchanger, and the heat exchange is hardly performed on the downstream side. Thus, the provision of the most downstream path corresponding to the area where the airflow velocity is low in the air conditioning device can improve the heat exchange efficiency in the relevant area.

It is preferable that a drain pan is provided below the heat exchanger, and that the most downstream path is provided, corresponding to a lower side of the heat exchanger.

Since the drain pan arranged below the heat exchanger becomes a resistance of the airflow, the velocity of the air passing through the lower side of the heat exchanger tends to be low. Accordingly, the provision of the most downstream path on the lower side of the heat exchanger can properly improve the heat exchange efficiency on the relevant lower side.

It is preferable that the fan is a sirocco fan including an impeller and a casing that contains this impeller and is formed with a discharge port of air, that the discharge port is open to an area on one side with respect to a virtual line perpendicular to a rotation axis of the impeller, and that the most downstream path is provided, corresponding to an area on another side of the virtual line.

Since the velocity of the airflow discharged from the sirocco fan becomes lower in an area on the opposite side of the discharge port, the provision of the most downstream path corresponding to this area can preferably improve the heat exchange efficiency.

Advantageous Effects of Invention

According to the present invention, heat exchange efficiency in the heat transfer tubes arranged in the most downstream row in the airflow direction can be improved, and cooling capacity can be enhanced.

DESCRIPTION OF EMBODIMENTS

Hereinafter, embodiments of the present invention will be described with reference to the drawings.

Figure 1:
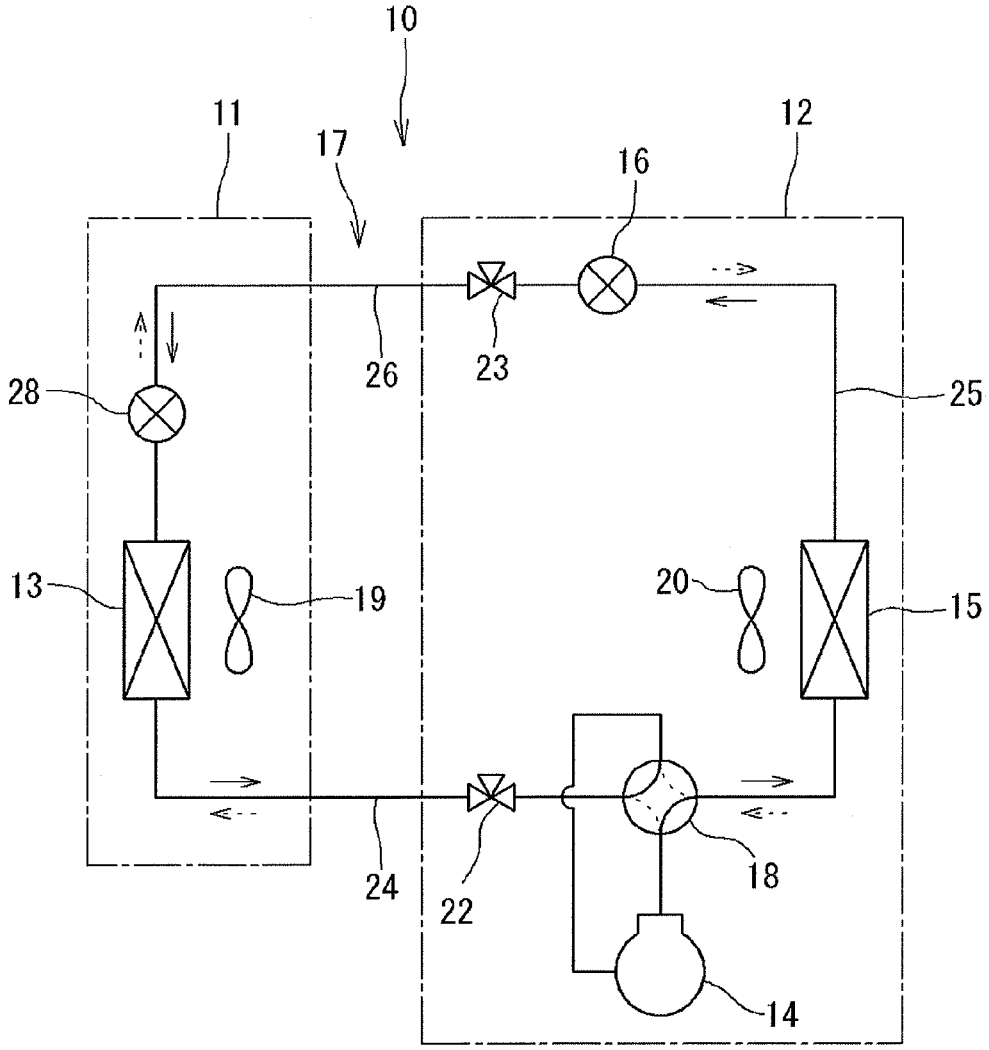
FIG. 1 is a configuration view of an air conditioning device according to a first embodiment of the present invention.

FIG. 1 is a configuration view of an air conditioning device in a first embodiment of the present invention. This air conditioning device 10 includes an indoor unit (a user-side unit) 11 and an outdoor unit (a heat source-side unit) 12.

The outdoor unit 12 is provided with a compressor 14, a four-way valve 18, an outdoor heat exchanger 15, an outdoor expansion valve 16 and the like, which are connected to one another by refrigerant pipes 25. Moreover, the outdoor unit 12 is provided with an outdoor fan 20.

A gas-side stop valve 22 and a liquid-side stop valve 23 are provided at terminal portions of an internal refrigerant circuit of the outdoor unit 12. The gas-side stop valve 22 is arranged on a side of the four-way valve 18, and the liquid-side stop valve 23 is arranged on a side of the outdoor expansion valve 16.

The indoor unit 11 is provided with an indoor expansion valve 28, an indoor heat exchanger 13 and the like. The gas-side stop valve 22 and the indoor heat exchanger 13 are connected to each other by a gas-side refrigerant communication pipe 24, and the liquid-side stop valve 23 and the indoor expansion valve 28 are connected to each other by a liquid-side refrigerant communication pipe 26.

In the air conditioning device 10 having the above-described configuration, when cooling operation is performed, the four-way valve 18 is maintained in a state indicated by solid line in FIG. 1. As indicated by solid arrow, a high-temperature, high-pressure gaseous refrigerant discharged from the compressor 14 flows into the outdoor heat exchanger 15 via the four-way valve 18, where the refrigerant performs heat exchange with outdoor air by the activation of the outdoor fan 20, thereby being condensed/liquefied. The liquefied refrigerant passes through the outdoor expansion valve 16 in an almost fully open state, and flows into the indoor unit 11 through the liquid-side refrigerant communication pipe 26. In the indoor unit 11, the refrigerant is decompressed to a predetermined low pressure in the indoor expansion valve 28, and performs heat exchange with indoor air in the indoor heat exchanger 13, thereby evaporating. The indoor air cooled by the evaporation of the refrigerant is blown into a room by an indoor fan 19 to cool the relevant room. Moreover, the refrigerant, which has evaporated into gas in the indoor heat exchanger 13, returns to the outdoor unit 12 through the gas-side refrigerant communication pipe 24, and is sucked into the compressor 14 via the four-way valve 18.

On the other hand, when heating operation is performed, the four-way valve 18 is maintained in a state indicated by dashed line in FIG. 1. As indicated by dotted arrow, the high-temperature, high-pressure gaseous refrigerant discharged from the compressor 14 flows into the indoor heat exchanger 13 of the indoor unit 11 via the four-way valve 18 to perform the heat exchange with the indoor air, thereby being condensed/liquefied. The indoor air heated by the condensation of the refrigerant is blown into the room by the indoor fan 19 to heat the relevant room. The refrigerant liquefied in the indoor heat exchanger 13 returns to the outdoor unit 12 through the liquid-side refrigerant communication pipe 26 from the indoor expansion valve 28 in an almost fully open state. The refrigerant, which has returned to the outdoor unit 12, is decompressed to a predetermined low pressure in the outdoor expansion valve 16, and performs heat exchange with the outdoor air in the outdoor heat exchanger 15, thereby evaporating. The refrigerant, which has evaporated into gas in the outdoor heat exchanger 15, is sucked into the compressor 14 via the four-way valve 18.

Figure 2:
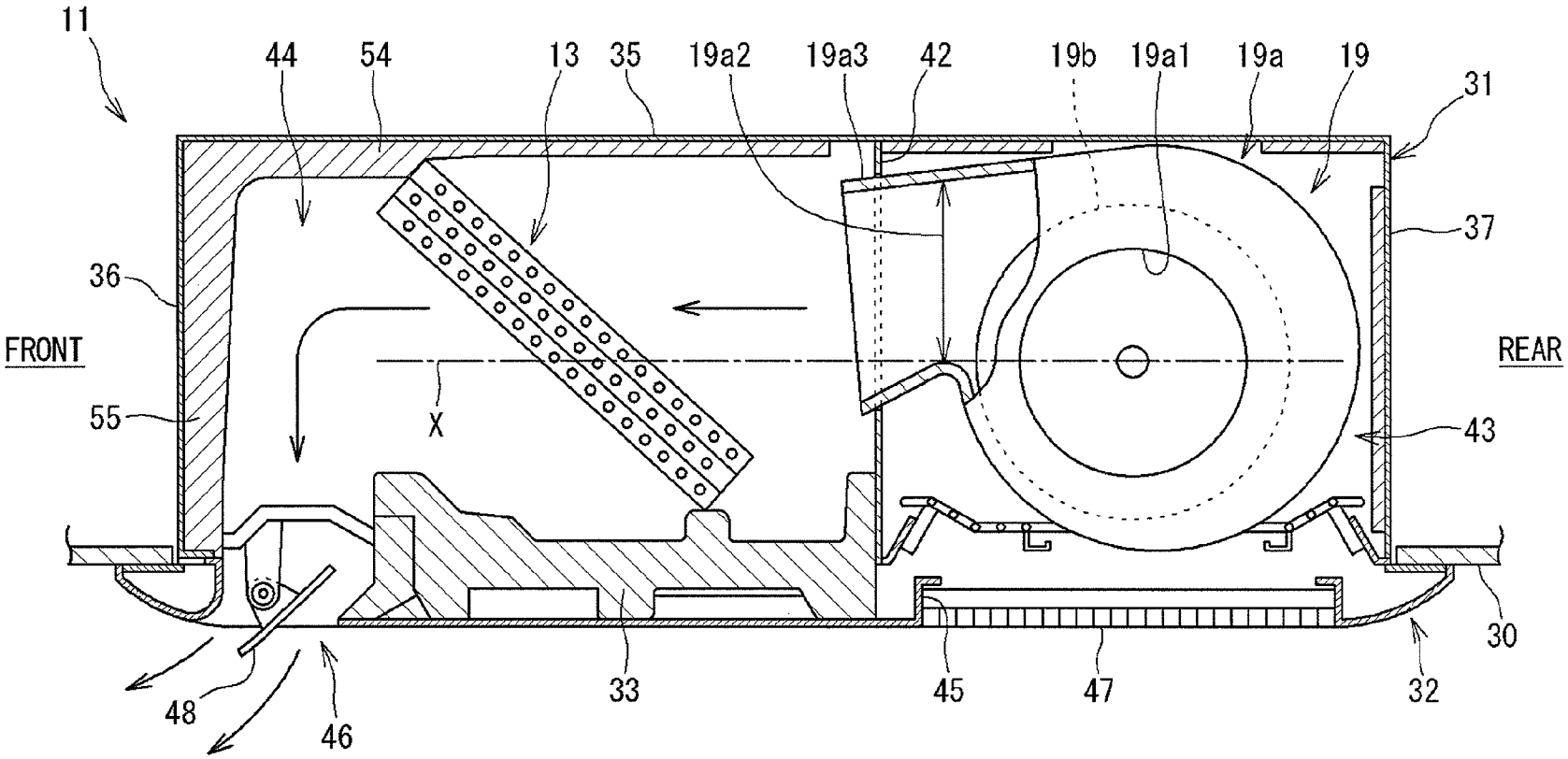
FIG. 2 is a side cross-sectional view (a cross-sectional view seen from an arrow direction along A-A in FIG. 3) showing an indoor unit of the air conditioning device.
Figure 3:
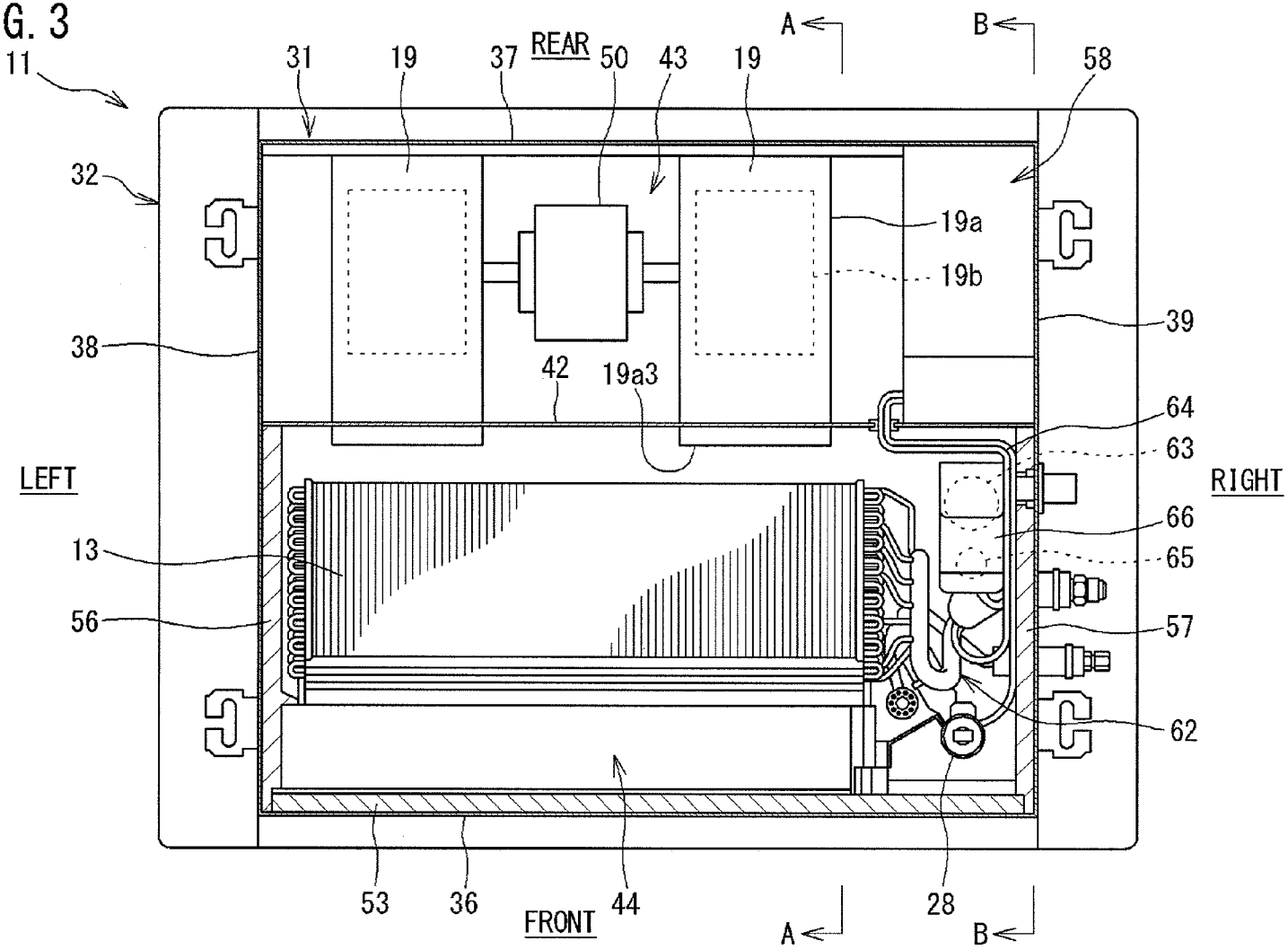
FIG. 3 is an explanatory plan view of the indoor unit.
Figure 4:
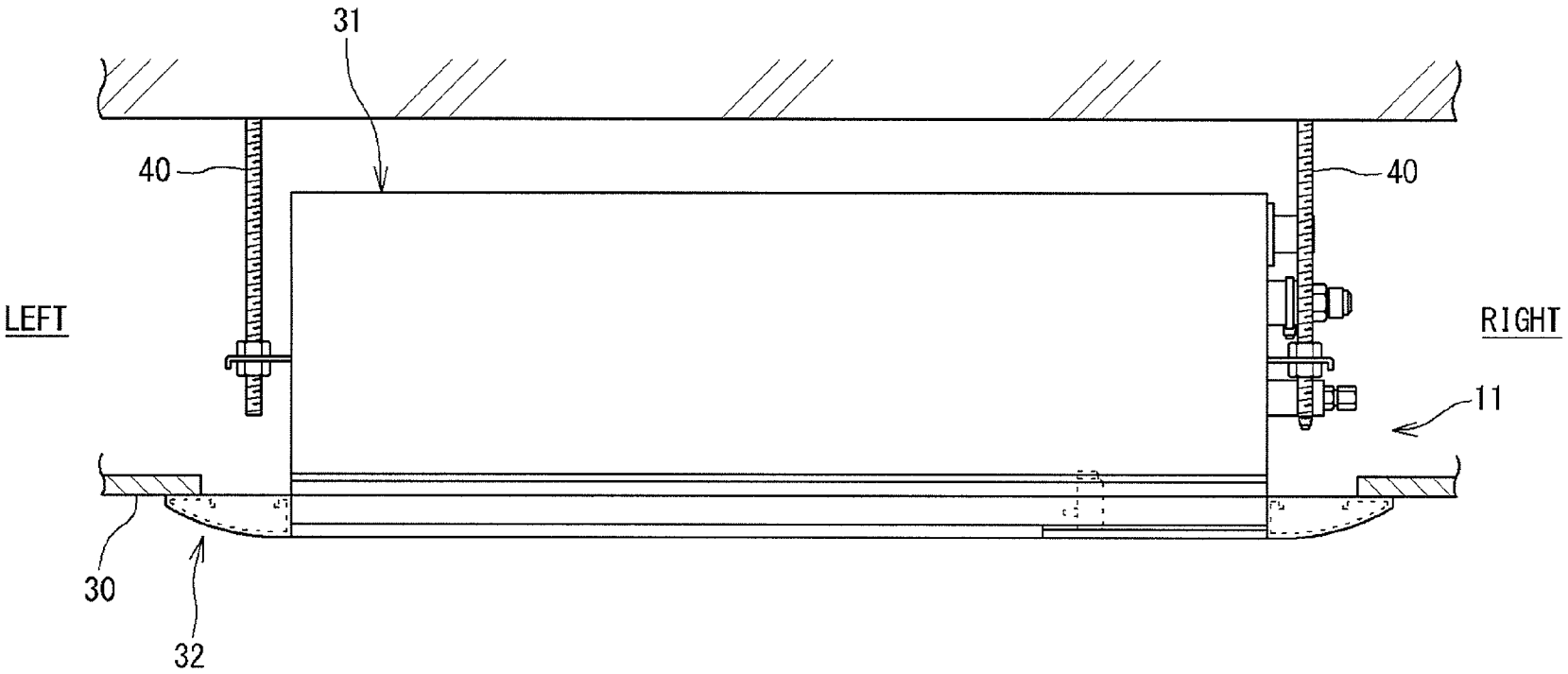
FIG. 4 is a front view of the indoor unit.
Figure 5:
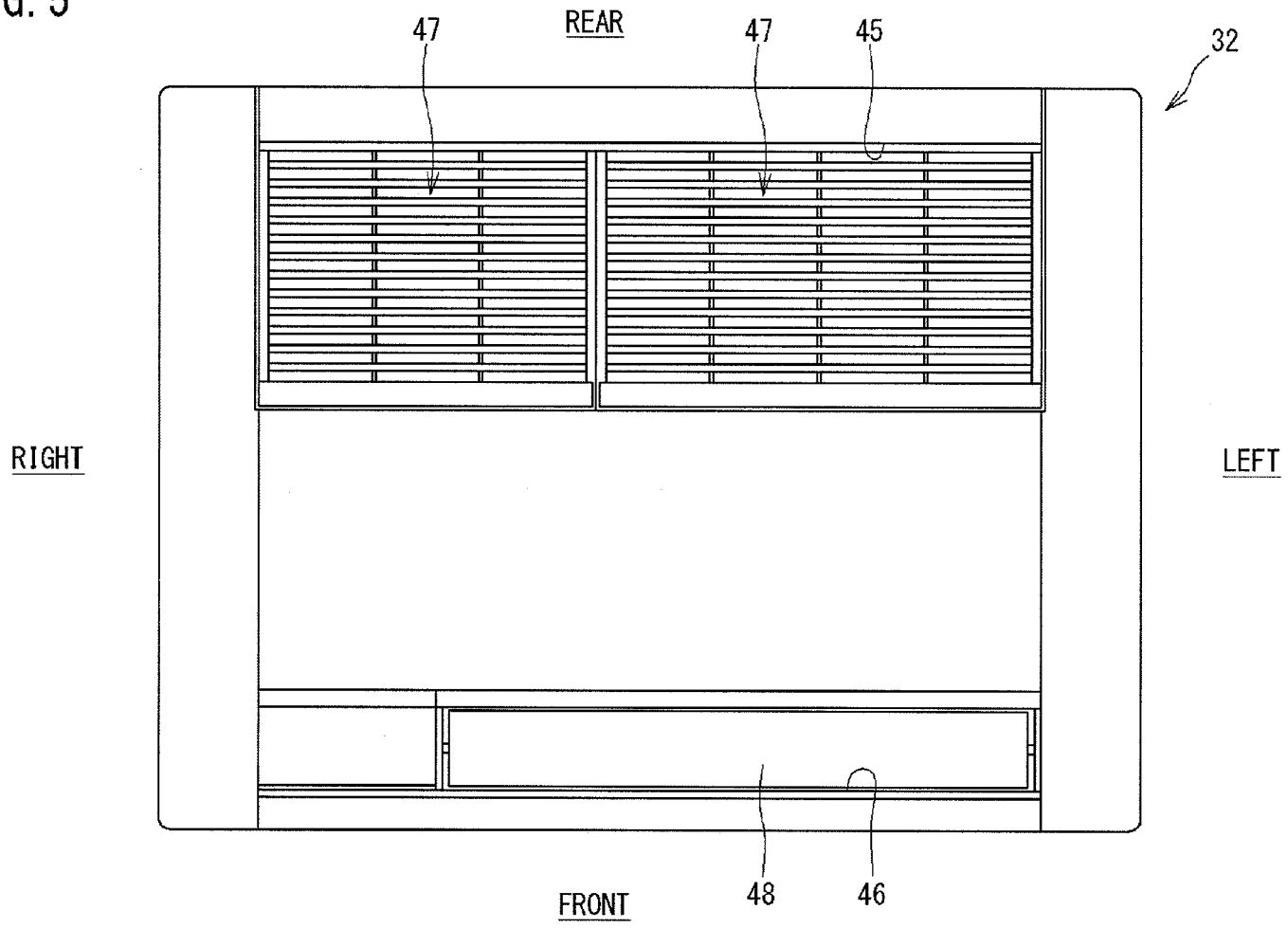
FIG. 5 is a bottom view of the indoor unit.

FIG. 2 is a side cross-sectional view (a cross-sectional view seen from an arrow direction along A-A in FIG. 3) showing the indoor unit 11 of the air conditioning device 10, FIG. 3 is an explanatory plan view of the indoor unit 11, FIG. 4 is a front view of the indoor unit 11, and FIG. 5 is a bottom view of the indoor unit 11.

The indoor unit 11 is a ceiling embedded indoor unit installed above a ceiling in a room, and includes a body case 31, a decorative panel 32, the indoor fans 19, the indoor heat exchanger 13, a drain pan 33 and the like.

The body case 31 is formed into a box shape open downward with a square upper wall portion 35 in planar view, and four circumferential wall portions (a front wall portion 36, a rear wall portion 37, a left wall portion 38, and a right wall portion 39) extending downward from four sides of the upper wall portion 35. The decorative panel 32 is attached to an opening portion at a lower end in the body case 31. As shown in FIG. 4, the body case 31 is suspended through suspending implements 40 from, for example, a lower surface of an upper floor above a ceiling 30, and the decorative panel 32 is arranged along a lower surface of the ceiling 30.

As shown in FIGS. 2 and 3, an interior of the body case 31 is sectioned into a fan chamber 43 and a heat exchange chamber 44 by a partition plate 42. Herein, a side of the fan chamber 43 is a rear side, and a side of the heat exchange chamber 44 is a front side.

The decorative panel 32 includes a suction port 45 below the fan chamber 43, and a blowing port 46 below the heat exchange chamber 44 on the front side. A grid-like grille 47 is attached to the suction port 45, and a baffle plate 48 that adjusts a blowing direction of air is swingably provided in the blowing port 46.

As shown in FIG. 3, in the fan chamber 43, the two indoor fans 19 are arranged at a distance from each other in a right-left direction. An electric motor 50 is arranged between the two indoor fans 19, and both of the indoor fans 19 are driven by this electric motor 50. As shown in FIG. 2, each of the indoor fans 19 of the present embodiment is a sirocco fan including a substantially cylindrical casing 19*a* and an impeller 19*b* provided inside this casing 19*a*. A suction port 19*a*1 is formed in a side surface of the casing 19*a*, a discharge port 19*a*2 is open in a front portion of the casing 19*a*, and an air guide cylinder 19*a*3 is projected forward from this discharge port 19*a*2. The air guide cylinder 19*a*3 is inserted in a state sealed to an opening formed in the partition plate 42.

When the indoor fans 19 are activated, the air in the room is taken into the fan chamber 43 from the suction port 45, and sucked into the suction ports 19*a*1 of the casings 19*a*, and then, is blown into the heat exchange chamber 44 from the discharge ports 19*a*2. Accordingly, an space inside the fan chamber 43 is a "suction space" into which the air is sucked by the indoor fans 19, and a space of the heat exchange chamber 44 is a "blowing space" into which the air is blown by the indoor fans 19.

In the heat exchange chamber 44, the indoor heat exchanger 13 is arranged. The indoor heat exchanger 13 is, for example, a cross-fin type fin and tube heat exchanger including a number of fins arranged side by side at predetermined intervals in the right-left direction, and heat transfer tubes provided so as to penetrate these fins. The indoor heat exchanger 13 is arranged to be inclined so that an upper portion thereof is located on the front side (a side of the blowing port 46: a downstream side of the airflow), and a lower portion thereof is located on the rear side (a side of the indoor fans 19; an upstream side of the airflow). The air blown into the heat exchange chamber 44 from the indoor fans 19 is subjected to heat exchange with the indoor heat exchanger 13, and then, is blown into the room from the blowing port 46. The drain pan 33 is provided below the indoor heat exchanger 13 so that dew condensation water produced in the indoor heat exchanger 13 is received by the drain pan 33.

The drain pan 33 is formed of a material having a high heat insulating property such as expanded polystyrene to also function as a heat insulating material. Moreover, as shown in FIGS. 2 and 3, in inner surfaces of the upper wall portions 35, the front wall portion 36, and the right and left wall portions 38, 39 of the body case 31 in the heat exchange chamber 44, heat insulating materials 54 to 57 made of expanded polystyrene or the like are provided, respectively.

Figure 6:
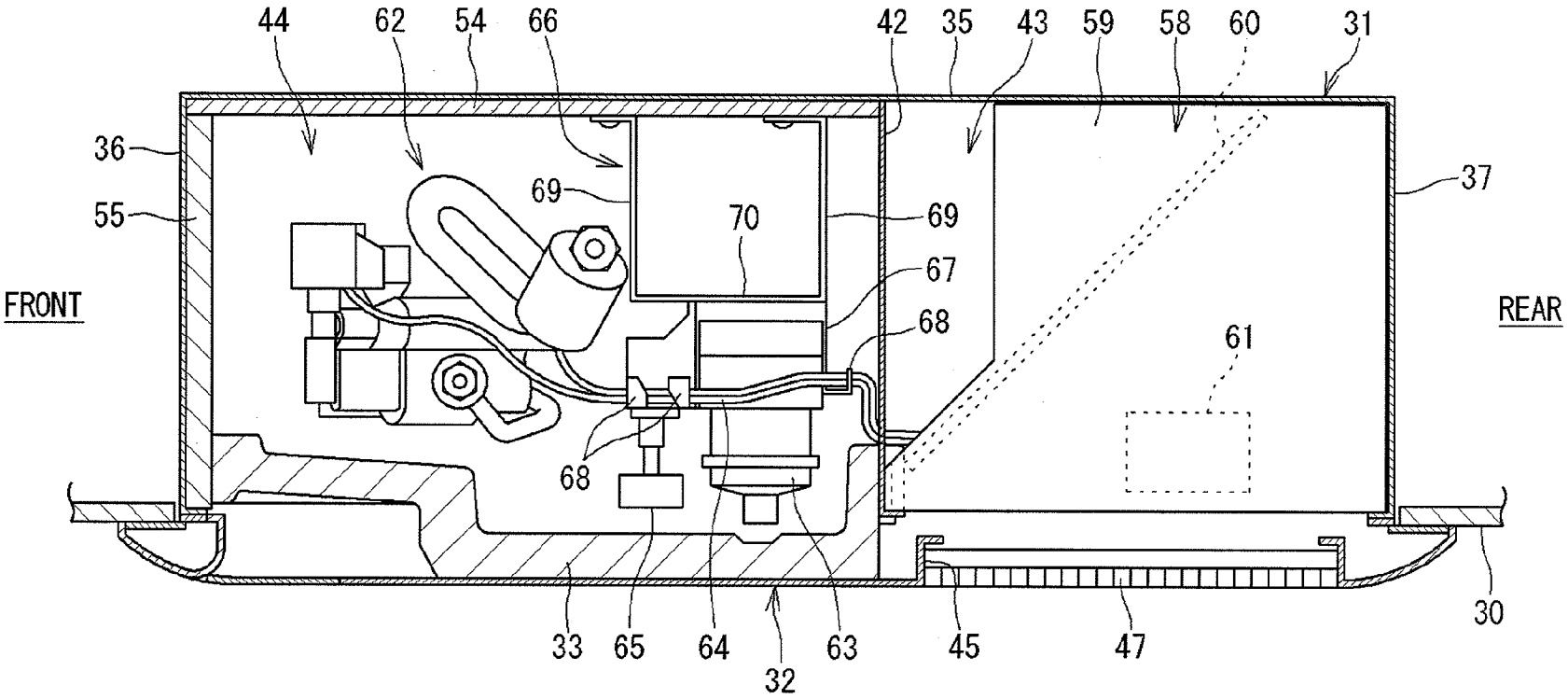
FIG. 6 is a side cross-sectional view (a cross-sectional view seen from an arrow direction along B-B in FIG. 3) of the indoor unit.

FIG. 6 is a side cross-sectional view (a cross-sectional view seen from an arrow direction along B-B) of the indoor unit. As shown in FIGS. 3 and 6, an electric component unit 58 is arranged in a right end portion of the fan chamber 43. This electric component unit 58 includes an electric component box 59, and a control board 60, a terminal table 61 and the like, which are contained in this electric component box 59. In a right end portion of the heat exchange chamber 44, a pipe group 62 such as a flow divider, a header and the like connected to the indoor heat exchanger 13, and electric parts such as a drain pump 63, the indoor expansion valve 28, a thermistor and the like are arranged. Electric wiring 64 of these electric parts is connected to the electric component unit 58 from the heat exchange chamber 44 through the partition plate 42.

As shown in FIG. 6, the drain pump 63 discharges the dew condensation water stored in the drain pan 33 by activation of an incorporated motor (an actuator). The drain pump 63 is mounted and fixed to the upper wall portion 35 of the body case 31 through a mount (a mounting member) 66. Moreover, a float sensor 65 is also mounted on the mount 66. The drain pump 63 and the float sensor 65 are assembled as one unit by a joining frame 67.

The mount 66 is formed into a U shape in side view by front and rear leg plates 69 and a base plate 70 connecting lower end portions of both the leg plates 69. Upper end portions of the leg plates 69 are fixed to the upper wall portion 35.

In the joining frame 67, guide claws 68 to guide the electric wiring 64 of the indoor expansion valve 28, the thermistor, the float sensor 65, the drain pump 63 and the like are formed integrally. This electric wiring 64 is supported by these guide claws 68 so that the electric wiring 64 does not sag to a side of the drain pan 33.

Figure 7:
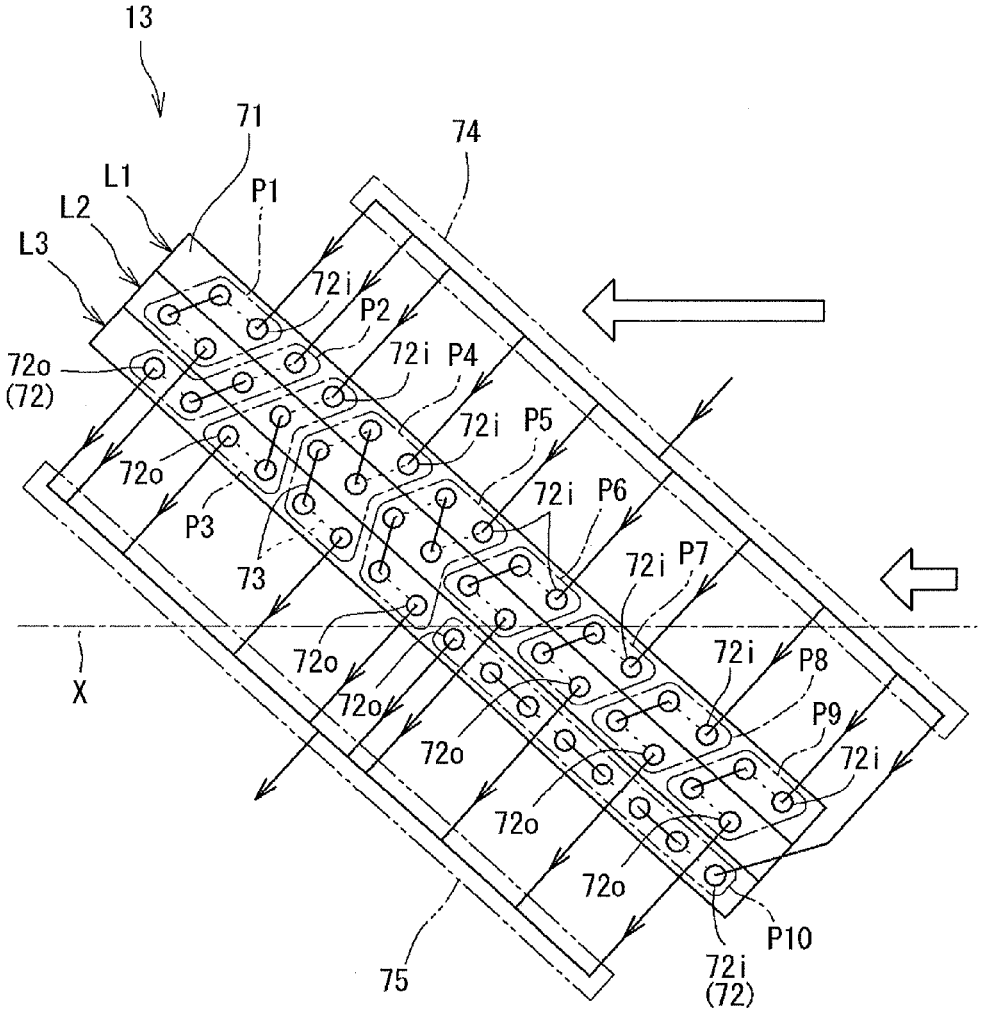
FIG. 7 is an explanatory side view of a heat exchanger.

FIG. 7 is an explanatory side view showing the indoor heat exchanger.

The indoor heat exchanger (hereinafter, simply referred to as a "heat exchanger" in some cases) 13 of the present embodiment has a number of fins 71 arranged side by side at the predetermined intervals in the right-left direction, and a plurality of heat transfer tubes 72 provided so as to penetrate these fins 71. The heat transfer tubes 72 are disposed in a plurality of stages in a height direction and in three rows L1 to L3 in the airflow direction. The refrigerant is distributed to a plurality of paths P1 to P10 by a flow divider 74 to be supplied to the plurality of heat transfer tubes 72, and the refrigerant flowing in the heat transfer tubes 72 of the respective paths P1 to P10 is joined by a header 75.

Figure 8:
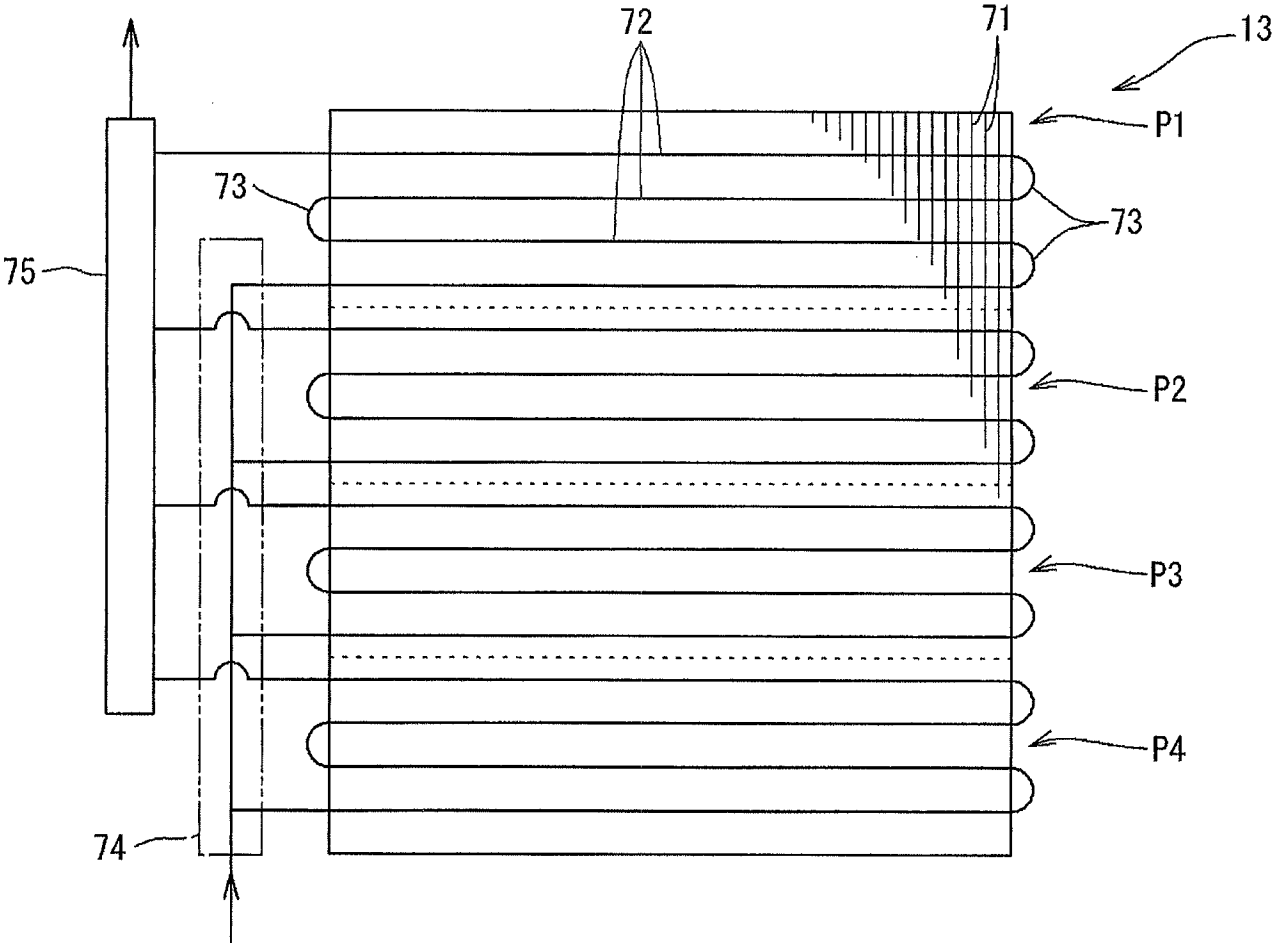
FIG. 8 is a schematic view in which the heat exchanger is simplified.

FIG. 8 is a schematic view showing a simplified configuration of the indoor heat exchanger. In the indoor heat exchanger 13 illustrated in FIG. 8, the refrigerant is distributed to the plurality of paths P1 to P4 in the vertical direction by the flow divider 74 to be supplied (borders of the respective paths P1 to P4 are shown by being sectioned by dotted line). In each of the paths P1 to P4, end portions of the plurality of (four in the illustrated example) heat transfer tubes 72 are connected by U-shaped connection tubes 73, by which one refrigerant flow channel going and returning (twice in the illustrated example) in the right-left direction is formed.

Referring back to FIG. 7, in the indoor heat exchanger 13 of the present embodiment, the refrigerant is distributed to the ten paths P1 to P10 by the flow divider 74. These paths P1 to P 10 can be broadly separated into the upper paths P1 to P5 arranged on an upper side of the indoor heat exchanger 13, and the lower paths P6 to P10 arranged on a lower side of the indoor heat exchanger 13. The upper paths P1 to P5 are paths including the heat transfer tubes 72 in the plurality of rows among the heat transfer tubes 72 arranged in the three rows in the airflow direction.

For example, the first path P1 arranged in an uppermost portion forms a refrigerant flow channel, in which the four heat transfer tubes 72 arranged in the first row L1 and the second row L2 go and return twice in the right-left direction. In FIG. 7, among the connection tubes 73 connecting the heat transfer tubes 72, front connection tubes are indicated by solid line, and back connection tubes are indicated by dotted line. The second and third paths P2, P3 each form a refrigerant flow channel, in which the four heat transfer tubes 72 arranged in the first row L1 to the third row L3 go and return twice in the right-left direction. Moreover, the fourth and fifth paths P4, P5 each form a refrigerant flow channel, in which the six heat transfer tubes 72 arranged in the first row L1 to the third row L3 go and return three times in the right-left direction. In any of the paths P1 to P5, the refrigerant is supplied to one of heat transfer tubes 72*i* arranged in the first row L1, and the refrigerant is caused to flow out from one of heat transfer tubes 72*o* arranged in the second row L2 or in the third row L3.

The lower paths P6 to P10 can be further classified into upstream paths P6 to P9 each forming a refrigerant flow channel, in which the four heat transfer tubes 72 arranged in the first row L1 and the second row L2 go and return twice in the right-left direction, and the most downstream path P10 forming a refrigerant flow channel, in which the eight heat transfer tubes 72 arranged in the third row L3 go and return four times in the right-left direction. In the upstream paths P6 to P9, the refrigerant is supplied to one of the heat transfer tubes 72*i* arranged in the first row L1 and is discharged from one of the heat transfer tubes 72*o* arranged in the second row L2. In the most downstream path P10, the refrigerant is supplied to the downmost heat transfer tube 72*i* and is discharged from the uppermost heat transfer tube 72*o*.

In the above-described configuration, during the cooling operation, the refrigerant (gas-liquid two phase refrigerant) supplied to the heat transfer tubes 72 of the respective paths P1 to P10 through the flow divider 74 performs heat exchange with the air passing through the indoor heat exchanger 13 to lower a temperature of the air. As to the air flowing in the indoor heat exchanger 13, a flow velocity thereof is higher on the upper side, and is lower on the lower side. This is partly because the drain pan 33 arranged below the indoor heat exchanger 13 becomes a resistance of the air. Moreover, another cause is that in the present embodiment, a sirocco fan is used as each of the fans 19, in which a most part of the discharge port 19*a*2 is open on an upper side of the casing 19*a* of this sirocco fan 19 (an upper side with respect to a substantially horizontal virtual line X perpendicular to a rotation axis of the impeller 19*b*).

Figure 11:
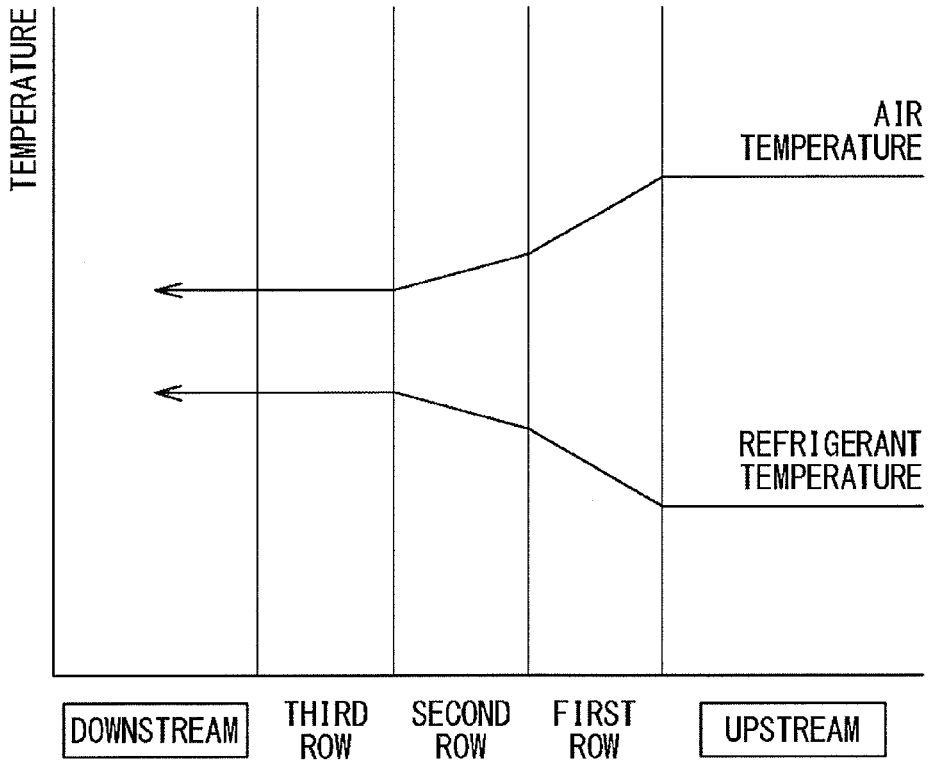
FIG. 11 is a graph for explaining temperature change of air and a refrigerant by a conventional heat exchanger.

If the flow velocity of the air passing through the indoor heat exchanger 13 is low, the heat exchange with the refrigerant is actively performed in the heat transfer tubes in the upstream rows, while in the heat transfer tubes in the downstream rows, a temperature of the refrigerant has already risen, so that the heat exchange with the air may hardly be performed, as described with reference to FIG. 11. Thus, in the present embodiment, the most downstream path P10 made up of only the heat transfer tubes 72 in the third row is provided on the lower side of the indoor heat exchanger 13 where the airflow velocity is low. The provision of the above-described most downstream path P10 enables the air after passing through the upstream paths P6 to P9 to be further cooled by the lower-temperature refrigerant. Accordingly, heat exchange efficiency in the heat transfer tubes 72 in the third row can be improved, thereby enhancing the cooling capacity.

Figure 9:
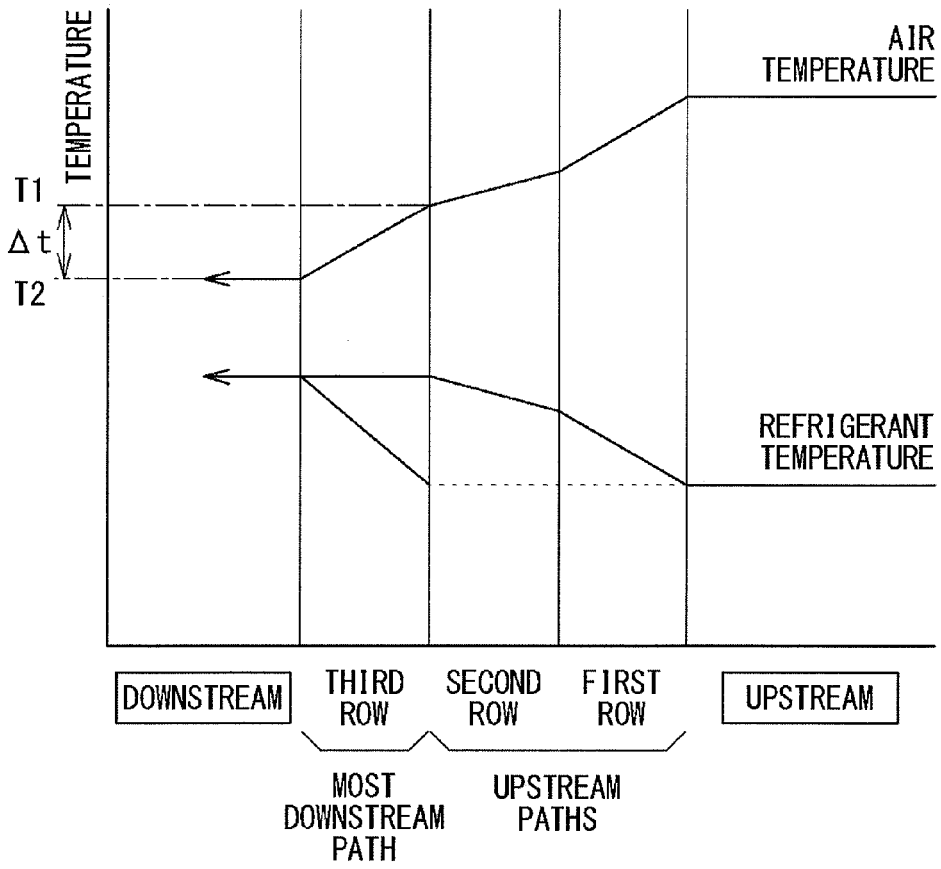
FIG. 9 is a graph for explaining temperature change of air and a refrigerant.

FIG. 9 is a graph for explaining temperature change of the air and the refrigerant in the lower paths P6 to P10.

As shown in FIG. 9, in the upstream paths P6 to P9, the heat exchange is performed between the refrigerant flowing in the heat transfer tubes 72 in the first row L1 and the second row, and the air, so that the temperature of the air is lowered to a temperature T1. Furthermore, in the most downstream path P10, since the low-temperature refrigerant flows in the heat transfer tubes 72 in the third row L3, the temperature of the air is cooled to a temperature T2, which is further lower than T1 by Δt.

Moreover, the most downstream path P10 is arranged across the downstream side of the plurality of upstream paths P6 to P9. This can sufficiently assure a length of the heat transfer tubes 72 in the downstream path P10. Accordingly, the heat exchange between the refrigerant flowing in the most downstream path P10, and the air can be sufficiently performed, and superheat of the refrigerant in a evaporation process can be properly attained.

Moreover, the most downstream path P10 is arranged in a lower area than a height X (also refer to FIG. 2) of a rotation center of the impeller 19*b* in each of the fans 19, that is, in an area where the airflow velocity is low, so that the heat exchange efficiency in the relevant area can be preferably improved.

In the upper side of the indoor heat exchanger 13, since the airflow velocity is high, the heat exchange between the refrigerant flowing in the heat transfer tubes 72 in the third row, and the air can be properly performed even though the most downstream path P10 having the above-described configuration is not provided. However, also on the upper side of the indoor heat exchanger 13, a most downstream path similar to that on the lower side may be provided.

Figure 10:
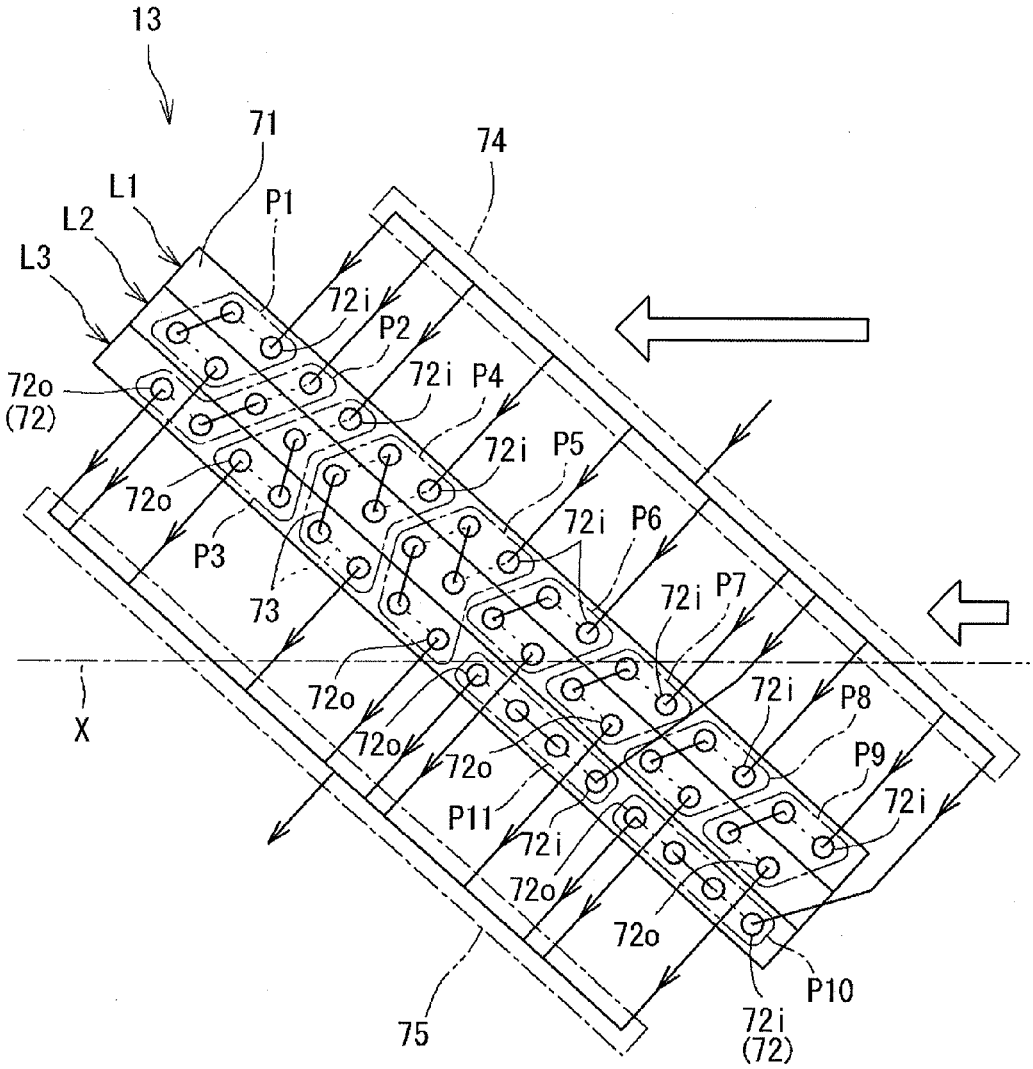
FIG. 10 is an explanatory side view showing a heat exchanger according to a second embodiment of the present invention.

FIG. 10 is an explanatory side view showing a heat exchanger according to a second embodiment of the present invention.

While in the heat exchanger 13 of the first embodiment shown in FIG. 7, the most downstream path P10 is made up of the eight heat transfer tubes 72, an indoor heat exchanger 13 of the present embodiment includes two most downstream paths P10, P11 each made up of four heat transfer tubes 72. Accordingly, also in the present embodiment, cooling capability can be preferably enhanced by the most downstream paths P10, P11 of the indoor heat exchanger 13. However, in the present embodiment, a length of the heat transfer tubes 72 in each of the most downstream paths P10, P11 is shorter, which makes it difficult to attain the superheat of the refrigerant in the evaporation process. In this respect, the first embodiment is more advantageous.

The present invention is not limited to the above-described embodiments, and any modifications can be made within the scope of the invention described in the claims, as needed.

For example, while in the above-described embodiments, the number of rows in the airflow direction of the heat transfer tubes 72 in the indoor heat exchanger 13 is three, it may be four or more. In this case, the most downstream path is made up of the heat transfer tubes 72 in the most downstream row, and the upstream paths are made up of the heat transfer tubes 72 in the plurality of rows arranged on the upstream side of the most downstream path.

The heat exchanger of the present invention is not limited to a heat exchanger including a ceiling-embedded indoor unit, but can be applied to an air conditioning device including a ceiling hanging type indoor unit, a wall type indoor unit or the like. Moreover, while the indoor heat exchangers of the above-described embodiments are arranged so as to be inclined with respect to the airflow direction, the indoor heat exchanger may be arranged perpendicular to the airflow direction.

REFERENCE SIGNS LIST

10: AIR CONDITIONING DEVICE
11: INDOOR UNIT
13: INDOOR HEAT EXCHANGER
19: INDOOR FAN
19A: CASING
19A2: DISCHARGE PORT
19B: IMPELLER
33: DRAIN PAN
72: HEAT TRANSFER TUBE
74: FLOW DIVIDER
75: HEADER
P6 to P9: UPSTREAM PATH

P10: MOST DOWNSTREAM PATH

The invention claimed is:

1. An air conditioning device comprising:

a heat exchanger comprising:

a plurality of heat transfer tubes arrayed in three or more rows in an airflow direction, a flow divider through which a refrigerant is distributed to a plurality of paths formed of respective subsets of the plurality of heat transfer tubes, and a header that receives the refrigerant that has flowed through the plurality of paths; and a fan that generates an airflow passing through the heat exchanger, wherein the heat exchanger is an evaporator during a cooling operation, the plurality of paths include a downstream path made up of only a subset of the plurality heat transfer tubes in a most downstream row in the airflow direction, and one or more upstream paths each made up of only a subset of the plurality of heat transfer tubes in a plurality of rows arranged on an upstream side of the most downstream row which includes the downstream path, and the downstream path of the heat exchanger is provided only at an area where an airflow velocity is low in the air conditioning device is lower than an area at which is provided another of the plurality of paths that includes at least one of the plurality of heat transfer tubes in the most downstream row.

2. The air conditioning device according to claim 1, wherein a drain pan is provided below the heat exchanger, and the downstream path is provided, corresponding to a lower side of the heat exchanger.

3. The air conditioning device according to claim 1, wherein the fan is a sirocco fan including an impeller and a casing that contains the impeller and is formed with a discharge port of air, the discharge port is open to an area on one side with respect to a virtual line representing a height of a rotation axis center of the impeller, and the downstream path is provided at an area on another side of the virtual line.

4. The air conditioning device according to claim 1, wherein the downstream path exists in an air flow path crossed by a plurality of upstream paths.

* * * * *